US007540162B2

(12) United States Patent
Nordstrom

(10) Patent No.: US 7,540,162 B2
(45) Date of Patent: Jun. 2, 2009

(54) DISPLAY CASE WITH IMPROVED SANITATION

(76) Inventor: Mark T Nordstrom, 16061 SE. Monner Rd., Portland, OR (US) 97236

( * ) Notice: Subject to any disclaimer, the term of this patent is extended or adjusted under 35 U.S.C. 154(b) by 0 days.

(21) Appl. No.: 11/849,674

(22) Filed: Sep. 4, 2007

(65) Prior Publication Data

US 2008/0053113 A1 Mar. 6, 2008

Related U.S. Application Data

(63) Continuation of application No. 11/110,597, filed on Apr. 19, 2005, now Pat. No. 7,263,843.

(51) Int. Cl.
*A47F 3/04* (2006.01)

(52) U.S. Cl. ..... 62/78; 62/255; 62/264; 362/92

(58) Field of Classification Search ..... 62/255–256, 62/78, 264, 231; 362/92
See application file for complete search history.

(56) References Cited

U.S. PATENT DOCUMENTS

| | | | | |
|---|---|---|---|---|
| 2,425,816 | A * | 8/1947 | Maxson | 62/231 |
| D243,985 | S | 4/1977 | Brown | |
| D244,019 | S | 4/1977 | Brown | |
| 4,023,378 | A | 5/1977 | Kennedy et al. | |
| D244,980 | S | 7/1977 | Kippenbrock et al. | |
| 4,077,228 | A | 3/1978 | Schumacher et al. | |
| 4,124,996 | A | 11/1978 | Kennedy et al. | |
| 4,315,414 | A | 2/1982 | Ibrahim | |
| 4,402,192 | A | 9/1983 | Henry | |
| 4,414,822 | A | 11/1983 | Ibrahim | |
| 4,416,120 | A | 11/1983 | Yono et al. | |
| 4,471,171 | A | 9/1984 | Kopke et al. | |
| RE31,909 | E | 6/1985 | Ibrahim | |
| 4,523,439 | A | 6/1985 | Denisot | |
| D280,476 | S | 9/1985 | McMahon et al. | |
| D280,790 | S | 10/1985 | Kooy | |
| 4,633,677 | A | 1/1987 | Maehara | |
| 4,750,335 | A | 6/1988 | Wallace et al. | |
| 4,777,806 | A | 10/1988 | Perez | |
| 4,807,446 | A | 2/1989 | Sunaga | |
| 4,840,040 | A | 6/1989 | Fung | |
| D302,910 | S | 8/1989 | Cocagne | |
| D307,080 | S | 4/1990 | Cocagne | |
| 4,930,321 | A | 6/1990 | Takahashi | |
| 4,938,034 | A | 7/1990 | Rosanio et al. | |
| 4,945,732 | A | 8/1990 | Haruyama et al. | |
| D311,290 | S | 10/1990 | Cocagne | |
| 5,048,303 | A | 9/1991 | Campbell et al. | |
| 5,129,584 | A | 7/1992 | Ridenour | |

(Continued)

*Primary Examiner*—William E Tapolcai
(74) *Attorney, Agent, or Firm*—J. Douglas Wells; Chernoff, Vilhauer, McClung & Stenzel, LLP

(57) ABSTRACT

A method and system for an improved display case, comprising a display case having air flow paths for circulating air around one or more objects displayable in a display area in the display case, and one or more ultraviolet radiation elements suitably positioned within the air paths for sanitizing the circulating air to reduce the amount of airborne contaminants therein. The display case may comprise a produce display case, meats display case, vegetables display case, floral display case, dairy display case, a frozen foods display case, or a similar type case.

19 Claims, 10 Drawing Sheets

U.S. PATENT DOCUMENTS

D334,495 S 4/1993 Bustos
5,261,253 A 11/1993 Spenard
D361,226 S 8/1995 Jones et al.
5,475,987 A 12/1995 McGovern
5,475,988 A 12/1995 McGovern
D365,828 S 1/1996 Lacewell et al.
D368,394 S 4/1996 Rogers
5,606,863 A 3/1997 Kicklighter et al.
5,645,330 A 7/1997 Artwohl et al.
5,675,983 A 10/1997 Ibrahim
D386,502 S 11/1997 Sholl
5,704,221 A 1/1998 Lego
5,755,108 A 5/1998 Ibrahim
5,860,289 A 1/1999 Wetzel
5,865,323 A 2/1999 Lecroy
5,868,262 A 2/1999 Carson
5,879,070 A 3/1999 Severloh
5,901,564 A * 5/1999 Comeau, II ..... 62/264
5,931,018 A 8/1999 Hall et al.
5,945,146 A 8/1999 Twinam
5,974,818 A 11/1999 Topper et al.
5,987,216 A 11/1999 Krug
5,992,651 A 11/1999 Shaw et al.
D421,028 S 2/2000 Valboni et al.
6,031,338 A 2/2000 Yoon et al.
6,173,575 B1 1/2001 Hall et al.
6,237,350 B1 * 5/2001 Hertel ..... 62/78
D449,467 S 10/2001 Bédard
6,298,615 B1 10/2001 Richardson
6,298,673 B1 10/2001 Fung et al.
6,302,036 B1 10/2001 Carson et al.
6,302,557 B1 10/2001 Santosuosso et al.
6,318,027 B1 11/2001 Richardson et al.
D452,393 S 12/2001 Bédard
6,325,523 B1 12/2001 Santosuosso et al.
6,350,710 B1 2/2002 Jonas et al.
6,367,223 B1 4/2002 Richardson et al.
6,379,240 B2 4/2002 Livchak et al.
6,381,976 B1 5/2002 Kempiak et al.
6,406,108 B1 6/2002 Upton et al.
6,411,916 B1 6/2002 Pellerin
6,449,967 B1 9/2002 Dubé
6,508,066 B1 1/2003 Mierins et al.
6,519,962 B1 2/2003 Schuetter
6,539,727 B1 4/2003 Burnett
6,539,741 B2 4/2003 Navarro
6,578,978 B1 6/2003 Upton et al.
6,606,832 B2 8/2003 Richardson et al.
6,606,833 B2 8/2003 Richardson et al.
6,606,869 B2 8/2003 Takahashi et al.
6,615,593 B2 9/2003 Thurman
6,629,422 B2 10/2003 Wellman
6,637,093 B2 10/2003 Richardson et al.
6,736,885 B2 * 5/2004 Kaiser ..... 96/224
7,044,851 B2 5/2006 Peterson et al.
2003/0150905 A1 * 8/2003 Mazzilli ..... 232/17

* cited by examiner

DISPLAY CASE WITH IMPROVED SANITATION

RELATED APPLICATIONS

This application is a continuation of U.S. application Ser. No. 11/110,597, filed Apr. 19, 2005, and claims the benefit of U.S. provisional application Ser. No. 60/564,004, filed Apr. 20, 2004. The specification of the above provisional application is incorporated herein by reference.

FIELD OF THE INVENTION

The present invention relates to systems and methods for controlling contaminants (bacteria, mold, yeast spores, microorganisms, and so forth) in refrigerated and non-refrigerated display cases typically found in grocery stores. More particularly, the invention relates to systems and methods utilizing one or more ultraviolet radiation source integrated within the air flow paths of a refrigerated or non-refrigerated display case.

BACKGROUND OF THE INVENTION

Grocery store display cases are generally used for the display of perishable items such as cut floral, meats and deli products, fruits or vegetables or other produce, or similar items typically requiring circulated air, typically circulated refrigerated air, to maintain the freshness and appearance of the displayed items for sale. The design of most grocery store display cases includes a lower drain trough that collects waste liquid runoff and debris. Air circulating fans and refrigeration coils are generally incorporated within this lower drain trough portion of the display case. The return intake airflow is generally located in front inner portion of the case. The circulated air is drawn down through this front inner portion of the case and flows directly over the drain trough by the air movement refrigeration fans which divert the air through the refrigeration coils. After passing through the refrigeration coils the air is then pushed up the back of the case and exits out the air vents and/or out the case canopy on top discharge models.

The drain trough area is where bacteria, mold, yeast spores, and so forth tend to collect and grow. Documented studies have shown airborne bacteria to be at higher levels in display cases where the air flows directly over the drain trough. The contaminated air in these display cases is recirculated and released directly onto the perishable products (fresh produce, meats, seafood, deli, cut floral, and so forth) shortening the shelf life of the products. Furthermore, the bacteria contaminated air is dispersed outward over the displayed product where there is likely to be contact with consumers and store employees. This creates conditions likely to promote the spread of harmful bacteria, viruses, and so on.

Similar problems exist with frozen product display cases, refrigerated beverage cases, or any display case where circulated or recirculated air may become contaminated. The contaminated air may then contaminate the displayed product and such product contamination and dispersion of harmful bacteria and so forth can contribute to the spread of disease or other health issues.

Another concern involves the ripening gas (ethylene) produced naturally from specific fruits and floral. The ripening gas produced from the products displayed in the display case is released into the air stream, captured in the refrigeration air stream and recirculated repeatedly over the product. As the gas is trapped in the air current, ethylene levels tend to increase which in turn speeds up the ripening process and thereby shortening the self life of the products displayed.

Yet another problem involves the downtime associated with the cleaning and maintaining the display cases. In order to clean and sanitize the cases, all products must be removed from the display racks. Sales are lost during this process since the cleaning process takes a substantial amount of time and generally cannot be completed when the store is closed. The majority of grocery retail stores are open nearly 24 hours per day or from very early in the morning until very late in the evening. The cleaning process is very labor intensive and additional man-hours are required, effecting net profits. Consequently, the frequency of cleaning and maintaining the display cases is minimized, further contributing to the build up of harmful bacteria, microorganisms, and so forth within the display cases.

Prior attempts to address the issue of case contamination include a device that automatically rinses the case's drip pans with water and a chemical solution. The dispensing plumbing pipe is mounted on the back panel of the internal case located directly under the product shelf racks. Spray nozzles are spaced evenly for the entire length of the case. The rinse system is cycled periodically during the day.

This technology only addresses the drip pan surface and does not address several other issues including the contaminated surfaces found below the drip pans. Furthermore, the rinse system does not contemplate and integrate methods and apparatus for effectively addressing airborne contamination within the display case.

The lower trough section of display cases typically includes refrigeration plumbing, refrigeration coils, various mounting and support brackets, and other mechanical obstructions. Because of the various obstructions and the general design of the drain trough, liquid runoff and debris from product are trapped from being rinsed down the waste drain. Consequently over a period of time the runoff solution combines with trapped debris and the debris begins to decay. Over a period of time the decaying debris creates an unpleasant odor not to mention unhealthy levels of harmful bacteria.

What is needed, therefore, are systems and methods for controlling contaminants (bacteria, mold, yeast spores, microorganisms, and so forth) in refrigerated and non-refrigerated display cases typically found in grocery stores. What is needed are display cases with improved sanitation.

BRIEF DESCRIPTION OF THE DRAWINGS

For a more complete understanding of the present invention, the drawings herein illustrate examples of the invention. The drawings, however, do not limit the scope of the invention. Similar references in the drawings indicate similar elements.

DETAILED DESCRIPTION

Figure 1A:
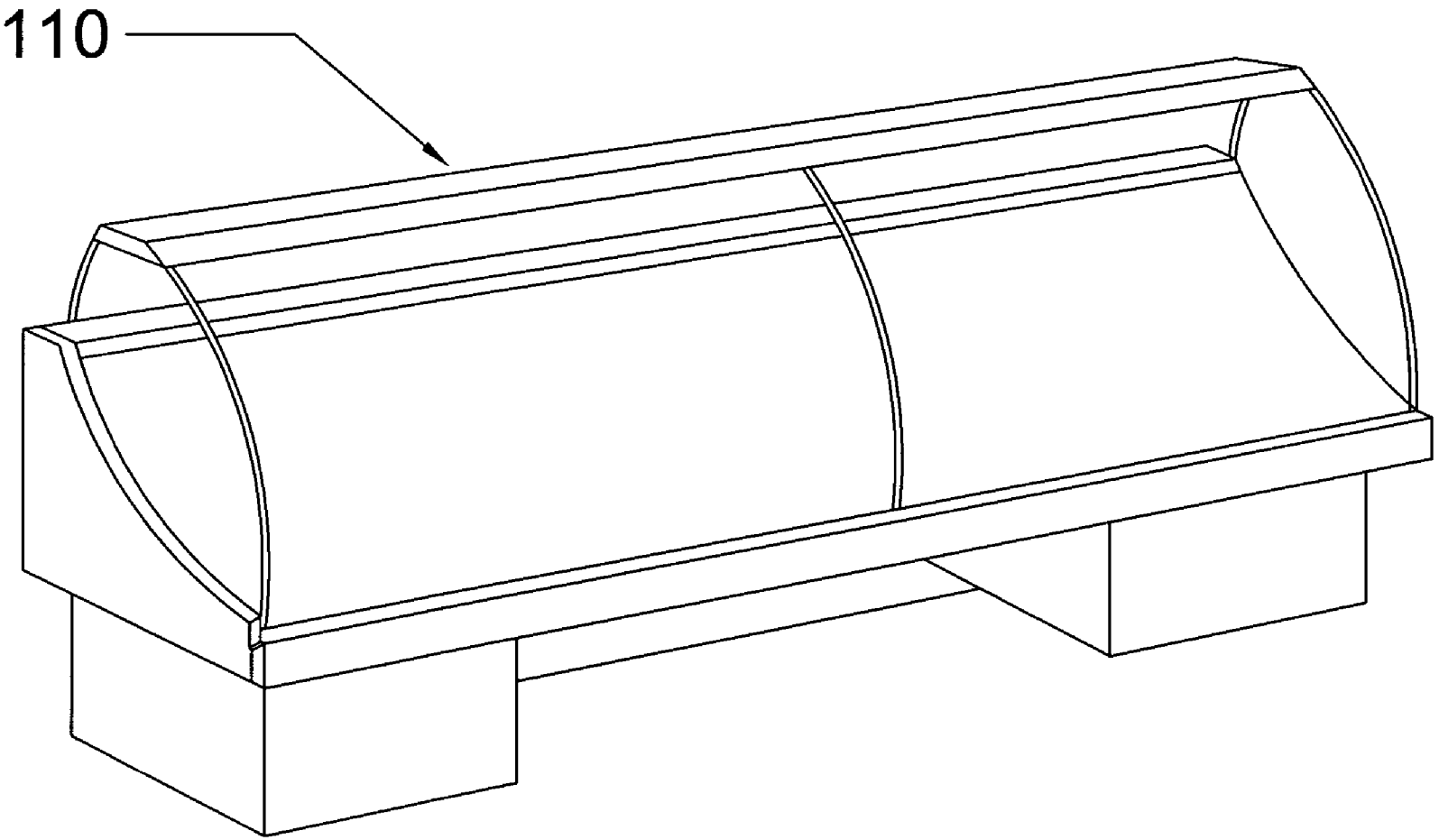
FIGS. 1*a*, 1*b*, and 1*c* illustrate display cases found in conventional retail supermarkets.

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Parts of the description will be presented using terminology commonly employed by those skilled in the art to convey the substance of their work to others skilled in the art. For example, a person having ordinary skill in the art will comprehend terms such as ultraviolet (UV), germicidal, erythemal, ozone, nanometer, UV-A, UV-B, UV-C, black light, DNA, and so on in the context and intended meaning of the present invention and within the spirit and scope of the present invention.

Various operations will be described as multiple discrete steps performed in turn in a manner that is helpful for understanding the present invention. However, the order of description should not be construed as to imply that these operations are necessarily performed in the order they are presented, nor even order dependent. Lastly, repeated usage of the phrase "in one embodiment" does not necessarily refer to the same embodiment, although it may.

The present invention, in one embodiment, involves display cases primarily located in retail grocery stores for use with perishable products and relates to methods and apparatus for controlling microorganisms (such as bacteria, mold, yeast spores, and so forth) and harmful gases in refrigerated or non-refrigerated display cases typically found in grocery supermarkets. More particularly, the invention relates to systems and methods utilizing one or more ultraviolet radiation source integrated within the air flow paths of a refrigerated or non-refrigerated display case.

The ultraviolet radiation source may comprise one or more ultraviolet radiation lamp. This special type of lamp may be used to emit high quantities of ultraviolet radiation (or ultraviolet light). The ultraviolet lamps create radiated energy (or light) at wavelengths which kill bacteria, viruses, molds, yeast spores, and other microorganisms. These wavelengths also render harmful gases benign or otherwise sanitary. Ultraviolet light is germicidal in that it deactivates the DNA within the exposed bacteria, viruses, and other pathogens, destroying their ability to grow and multiply. Specifically, the ultraviolet light causes damage to the nucleic acid of microorganisms by forming covalent bonds between certain adjacent bases in the DNA. The formation of such bonds prevents the DNA from being unzipped for replication, and the organism is unable to reproduce. Thereafter, when the organism tries to replicate, it simply dies.

As will be discussed further below, the ultraviolet wavelengths chosen comprise, in one embodiment, ultraviolet wavelengths with maximal germicidal effect, the ultraviolet wavelengths most lethal to virus, bacteria, mold, yeast spores, and so forth. Therefore, exposing the air circulated throughout the air paths of a display case to sufficient ultraviolet light comprises an effective method for removing airborne contaminates from within the display case. Moreover, exposing surfaces of the display case with sufficient ultraviolet light comprises an effective method for sanitizing those surfaces. For example, exposing the surfaces in the lower drain trough area of the display case deactivates and renders harmless any microorganisms found on those surfaces (and exposed to the ultraviolet light).

Figure 1B:
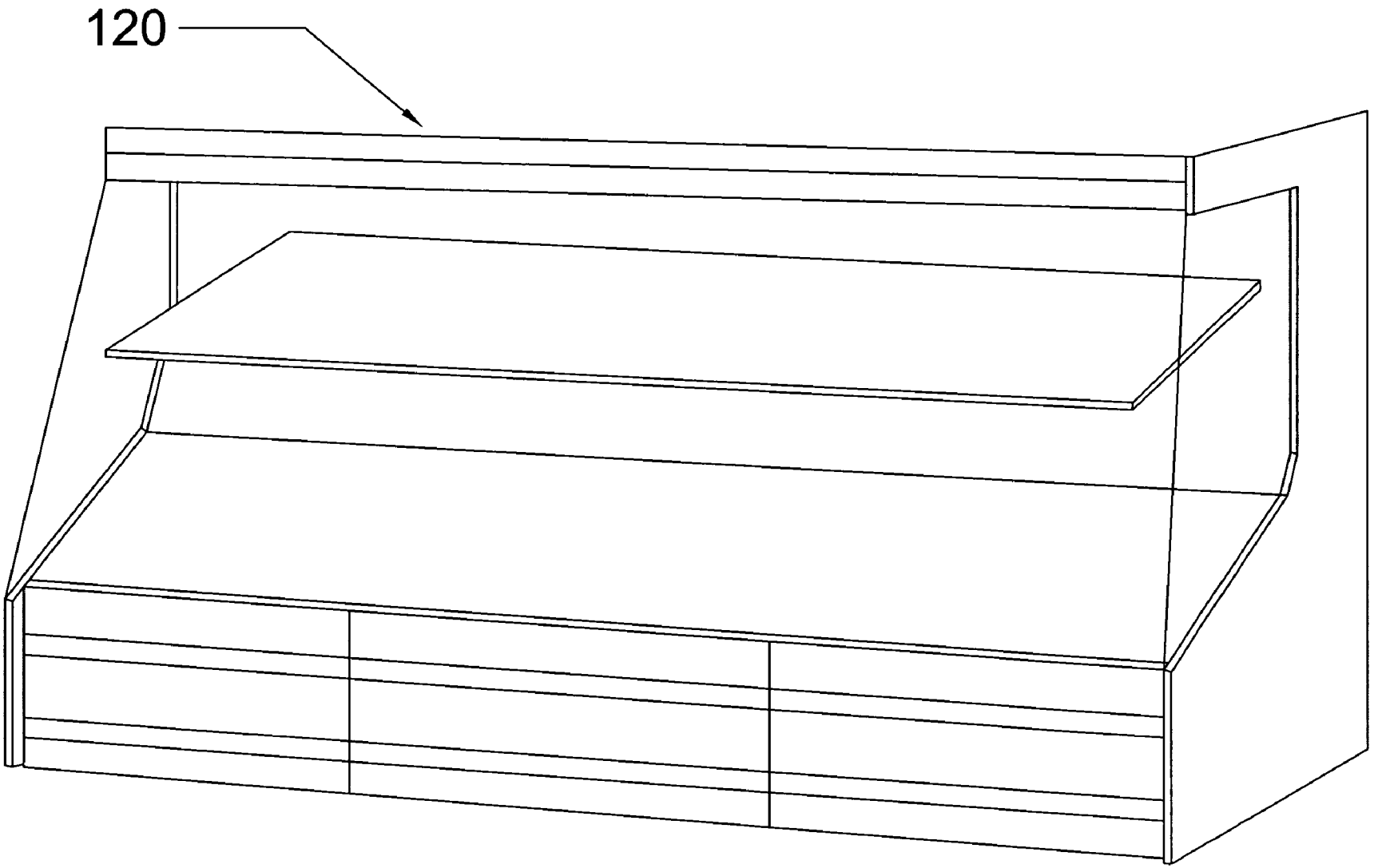
Figure 1C:
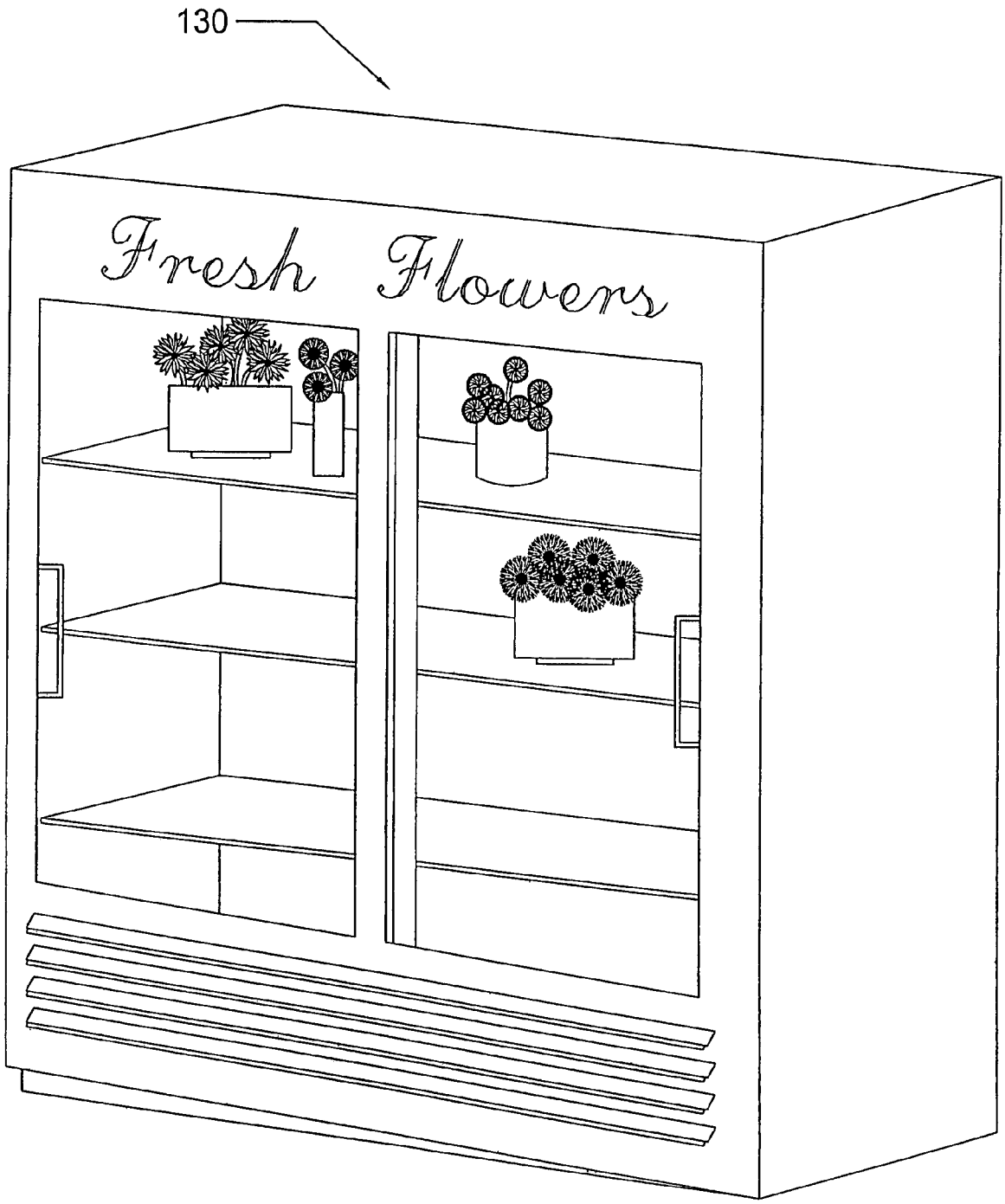

Various display cases may be improved using the methods and apparatus disclosed and claimed herein. FIGS. 1*a*, 1*b*, and 1*c* illustrate display cases found in conventional retail supermarkets. Most of the display cases are designed to circulate refrigerated air throughout the display areas of the display case. Specific models are intended for various departments located in such retail stores. For example, FIG. 1*a* illustrates a seafood, meat, and deli type display case 110. As shown, such cases typically include transparent top enclosures over the displayed product that open from the back where a store employee may access the display case to pull out a particular or customer selected product. The front of the case, where customers view and select the products, typically does not open and is not designed for easy access. Moreover, many deli departments use the top surface of the display case for measuring scales, packaging materials for customer sections, and so forth. Thus, cleaning a display case such as display case 110 is particularly cumbersome. Food debris is likely to accumulate over time, increasing the amount of decaying material and undesirable airborne contaminants.

FIG. 1*b* illustrates a display case 120 for produce such as fruits or vegetables. Display cases of the type shown (such as display case 120) are designed to back up against a wall and have open front display areas where customers may reach into the display areas for inspection and selection of the food products displayed therein. The display case 120 shown is perhaps the most common configuration used for produce in grocery stores. As will be discussed in greater detail below, the display case 120 circulates refrigerated air over and through the displayed food products using fans and refrigeration coils within the lower trough portion of the display case. Misting and other humidification and wash down systems are commonly used with these types of produce display cases. The water is used to improve the shelf life of the produce, to clean the produce, and to wash down the display area in general. Consequently, the lower trough areas of such display cases tend to collect and hold food debris and moisture, creating favorable conditions for the growth of undesirable bacteria and other microorganisms. Tests have shown that the food debris trapped within the lower trough areas of such display cases (and within the refrigeration coils and other mechanical obstructions within the lower trough areas) causes increases in the amount of undesirable airborne contaminants measurable within the air circulating throughout the display case.

FIG. 1*c* illustrates a floral display case 130. A wide variety of floral display cases are available. Most have vertical shelving and sliding glass front panels from which customers or store employees may handle the displayed products. As with other types of display cases, floral display cases generally involve circulated cooled air and similar problems with airborne contaminants.

As mentioned, most display cases are refrigerated to help prolong the shelf life of the perishable products displayed. Typical displayed product includes flowers, fruit, vegetables, meats, eggs, milk, other dairy, and a wide variety of other perishable products. However, the present invention is applicable to any product requiring or using circulated or recirculated air flow or any display case having similar air flow paths. As previously mentioned, frozen product display cases and beverage cooling cases are a couple of examples.

Figure 2:
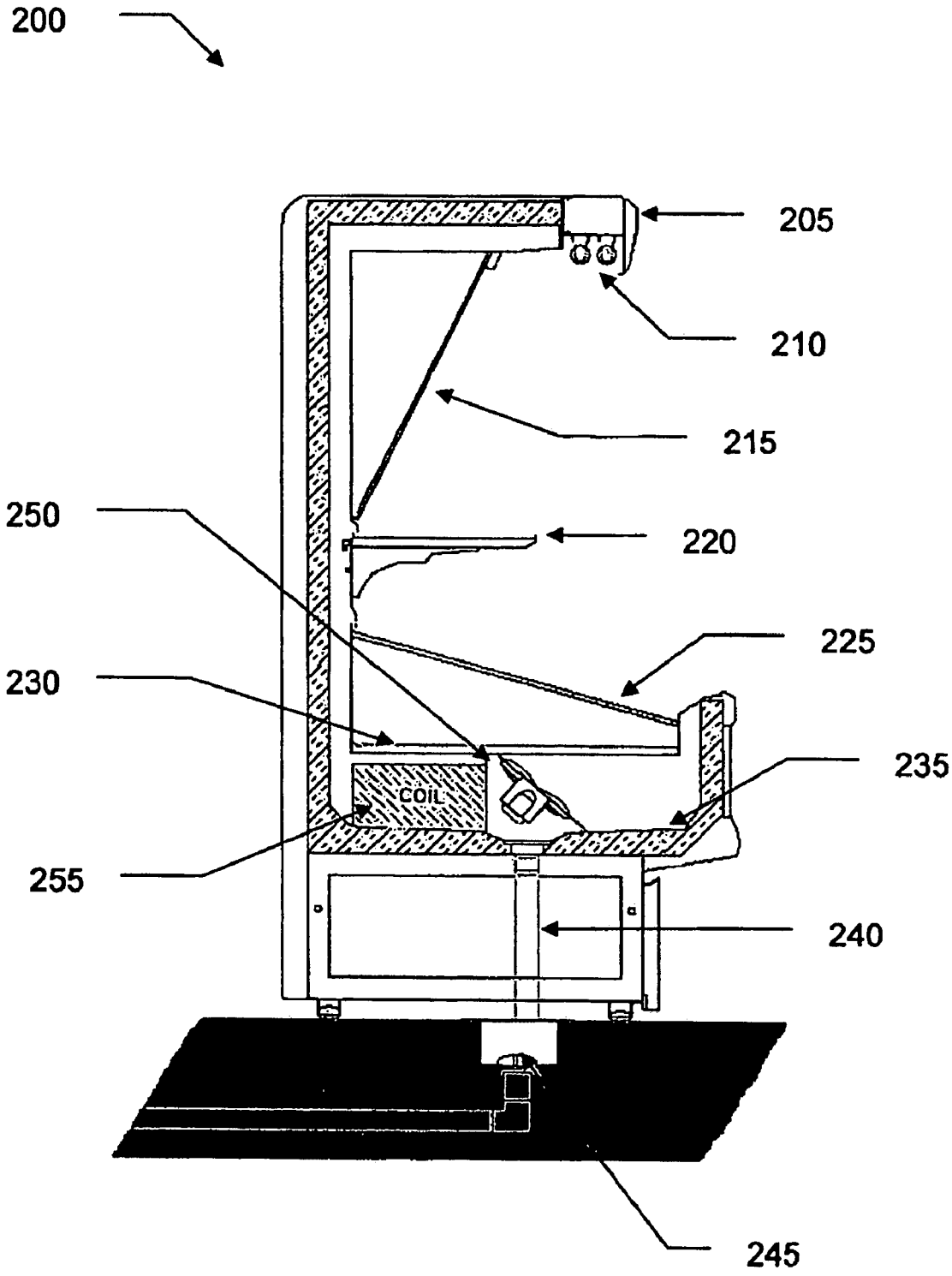
FIG. 2 illustrates a side view of a typical display case.

The side view of a typical display case is illustrated in FIG. 2. As shown, the refrigerated display case 200 may incorporate an external and internal framed structure. The display case 200 has a canopy 205 forming the top of the display case and provides lighting 210. Mirrors 215 are commonly incorporated into the display case for allowing customers standing in front of the case to more easily inspect the food products in the display area of the display case, such as on shelves 220 or display racks 225. The shelving 220 and display racks 225 are typically fabricated of wire mesh or other similarly porous construction that allows water to drain off of the displayed products downward into the drip pan 230 and lower drain trough area 235. The drip pan 230 may be fabricated with holes for allowing circulating air and water runoff to flow downward through the products displayed on the display racks 225. The drip pan 230 is typically a mesh or porous material intended to catch larger debris yet still allow water runoff to pass through to the lower drain trough area 235 below. Drain sources 240 are typically located within the lower drain trough area 235 for directing water runoff out of the display case 200 and into associated floor drains 245 provided below the display case 200. The water runoff, as will be discussed in greater detail, flows downward through the display racks 225 and drip pans 230 and onto the air fans 250, refrigeration coils 255, and other components and surfaces located in the lower trough area.

Figure 3:
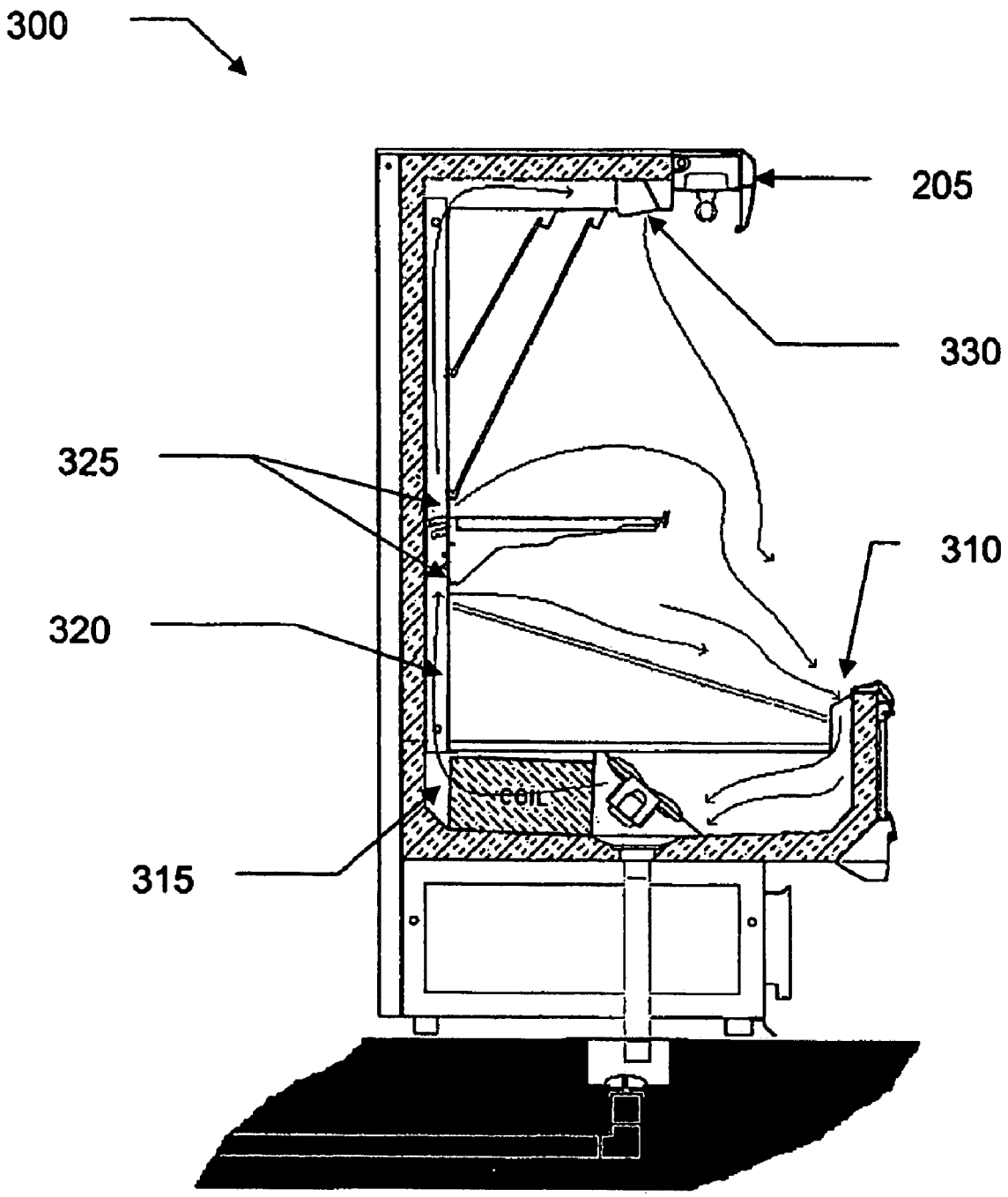
FIG. 3 illustrates air flows within a typical display.

As shown in FIG. 3, for a typical display case 300 not yet incorporating the present invention, air is drawn from the front of the case, at air return intakes 310, down into the lower portion of the case. The refrigeration air fans draw the air across the lower drain trough area, through the refrigeration coils, and received into an air discharge chamber 315 where the air is the diverted upward through air flow paths 320 within the display case 300. The refrigerated circulating air flows through the air discharge chamber 320 up to the air exhaust vents 325 generally located on the interior back panel of the display case. Air is ventilated out of the air exhaust vents 325 on the interior panel and into the display area to achieve the desired cooling effect on the products displayed, thus prolonging the shelf life or maintaining the desired product characteristics for display (i.e. cooled beverages, frozen foods, appropriately refrigerated meats, chilled floral cuts, and so on). For top discharge display cases, as for the display case 300, circulating air flows up the back wall of the display case and discharged from air exhaust vents 330 located in the top or canopy 205 portion of the display case. Although not shown, some air vented from the various exhaust vents may be dispersed outside of the display case, especially when customers disrupt the driven air flows by reaching in to the display case, cause air currents by walking past the display case, and so forth. Likewise, although not shown, some air from outside the display case driven air flows may enter through the air return intakes 310 or through the drip pan areas.

Figure 4:
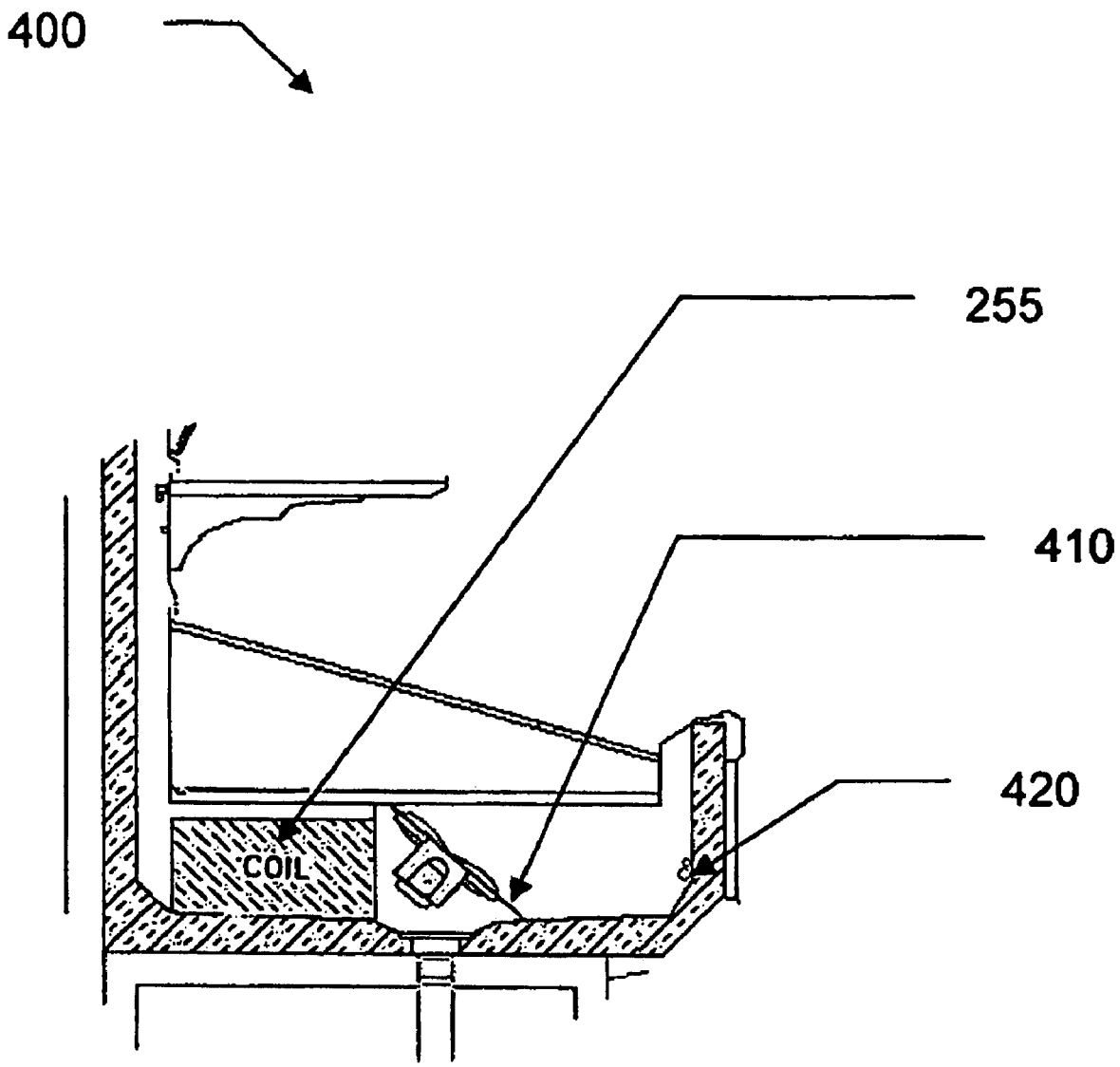
FIG. 4 depicts various obstructions within a typical display case which tend to trap liquid runoff and other debris.

FIG. 4 is an illustration depicting various refrigeration components in the lower portion 400 of a display case which tend to trap liquid runoff within the display case. Instead of accumulation in the drip pans or elimination through the drain sources, product debris and liquid runoff collects on the components below the drip pans. For example, the circulating air fans and fan shields 410, refrigerant (Freon, etc.) lines 420, and refrigeration coils 255 tend to trap the debris and runoff. This environment becomes a breeding ground for bacteria, mold, yeast spores, and other microorganisms. Contamination in such areas is particularly problematic since cleaning and sanitization in those areas is impractical. Doing so would require dismantling the display case and is not possible in the course of operating such display cases. Even with disassembly, decaying debris trapped within the refrigeration coils 255 is often impossible to remove without r replacement of the refrigeration coils.

Figure 5:
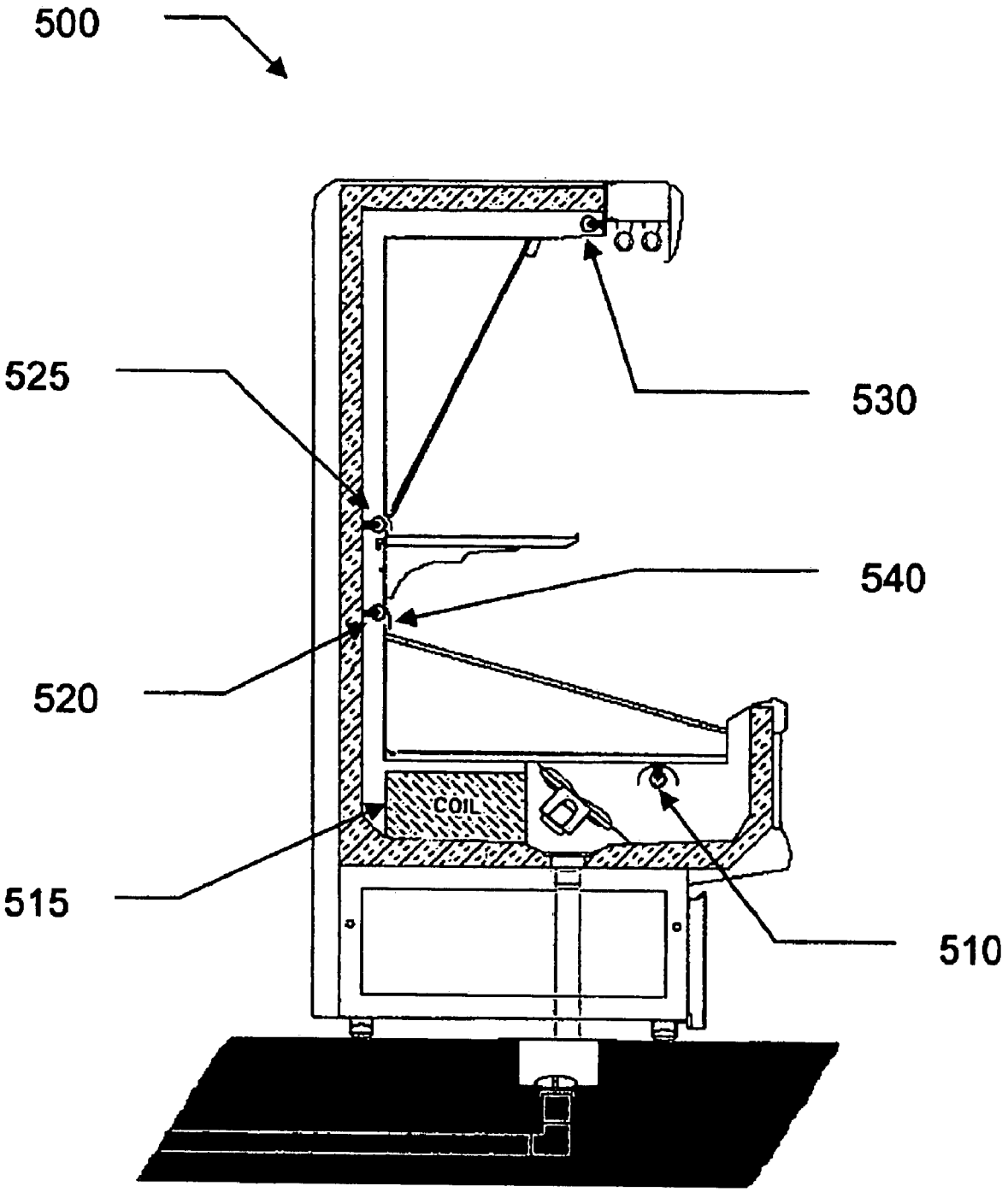
FIG. 5 illustrates a side view of a display with improved sanitation characteristics according to one embodiment of the present invention.

According to one embodiment of the present invention, FIG. 5 illustrates a side view of a display case 500 having ultraviolet radiation elements (or ultraviolet radiation lamps) installed in various locations for deactivating both surface and airborne bacteria and gases. In one embodiment, the ultraviolet lamps are advantageously placed to maximize the sanitization of the circulated air, especially where air is vented into the product display area of the display case and especially in the lower trough area where contaminants tend to accumulate. For example, and as shown in FIG. 5, the lower drain trough area of the display case may be fitted with ultraviolet lamps 510 for sanitizing the surfaces within the lower trough area and for sanitizing the circulating air flowing into the lower trough area and received into the refrigeration coils. Circulating air received from the refrigeration coils may be sanitized by ultraviolet lamps 515 positioned behind the refrigeration coils. In one embodiment, the ultraviolet lamps 515 may be positioned within the air flow paths of the display case comprising the air discharge chamber behind the refrigeration coils. In one embodiment, ultraviolet lamps 510 and 515 are suitably positioned before and after the refrigeration coils so as to sanitize the surfaces within the lower trough area and the circulating air passing through the lower trough area and refrigeration coils. In one embodiment, ultraviolet lamps 520, 525, and 530 may be suitably positioned within the air flow paths proximate to air exhaust vents at which circulating air sanitized by the ultraviolet lamps is released into the display area within the display case 500. In another embodiment, one or more ultraviolet lamp (such as ultraviolet lamps 520, 525, and/or 530) may be suitably positioned within the air flow paths of the display case to sanitize the circulating air passing through the air flow paths and released outward into the display area of the display case.

Each of the ultraviolet lamps 520, 525, and 530 may be fitted with reflective shielding, as with the reflective shielding 540 as shown with ultraviolet lamps 520, to prevent ultraviolet light from directly entering the product display area or areas outside of the display case. The reflective shielding may be applied wherever necessary to prevent direct exposure to ultraviolet light. For example, the ultraviolet lamps 530 may include protective baffles to prevent ultraviolet light from leaking downward toward the display area (and any displayed products therein) or from leaking outward toward customers or employees standing near the display case. The reflective shielding may also be used to concentrate or intensify the ultraviolet energy radiated from the ultraviolet lamps so as to thoroughly sanitize the circulating air flowing proximate to the ultraviolet lamps and the desired surface areas. For instance, ultraviolet lamps 510 may comprise reflective shielding to prevent upward ultraviolet light exposure to employees or customers or products through porous areas of the drip pans (or when the drip pans are removed for display case maintenance). The reflective shielding associated with ultraviolet lamps 510 may also serve to concentrate the ultraviolet radiation toward the circulating air flowing within the lower trough area and the surfaces of the lower trough area. The reflective shielding may also be used to prevent direct contact between the ultraviolet lamp and various attachments within the display case. For example, the reflective shielding used with ultraviolet lamps 510 may shield the ultraviolet lamps from direct contact with mechanical components of the drip pans, direct contact with debris or parts of displayed product that may fall onto the ultraviolet lamps, direct contact with water or runoff from the drip pans or other areas of the display case, and so on.

Further, each of the ultraviolet lamps may be fitted with water resistant enclosures or water tight sealants to prevent malfunction or electric shock due to operation of the ultraviolet lamps in humid or wet environments. For example, the ultraviolet lamps 510 within the lower trough area may be subjected to humid, damp, and wet conditions. Likewise, the ultraviolet lamps 515 near the refrigeration coils may be subjected to similarly wet conditions. One or more of the ultraviolet lamps 520, 525, and 530 may also be subjected to highly damp conditions, especially if misting or automatic water spray systems are used within the display case 500.

Figure 6:
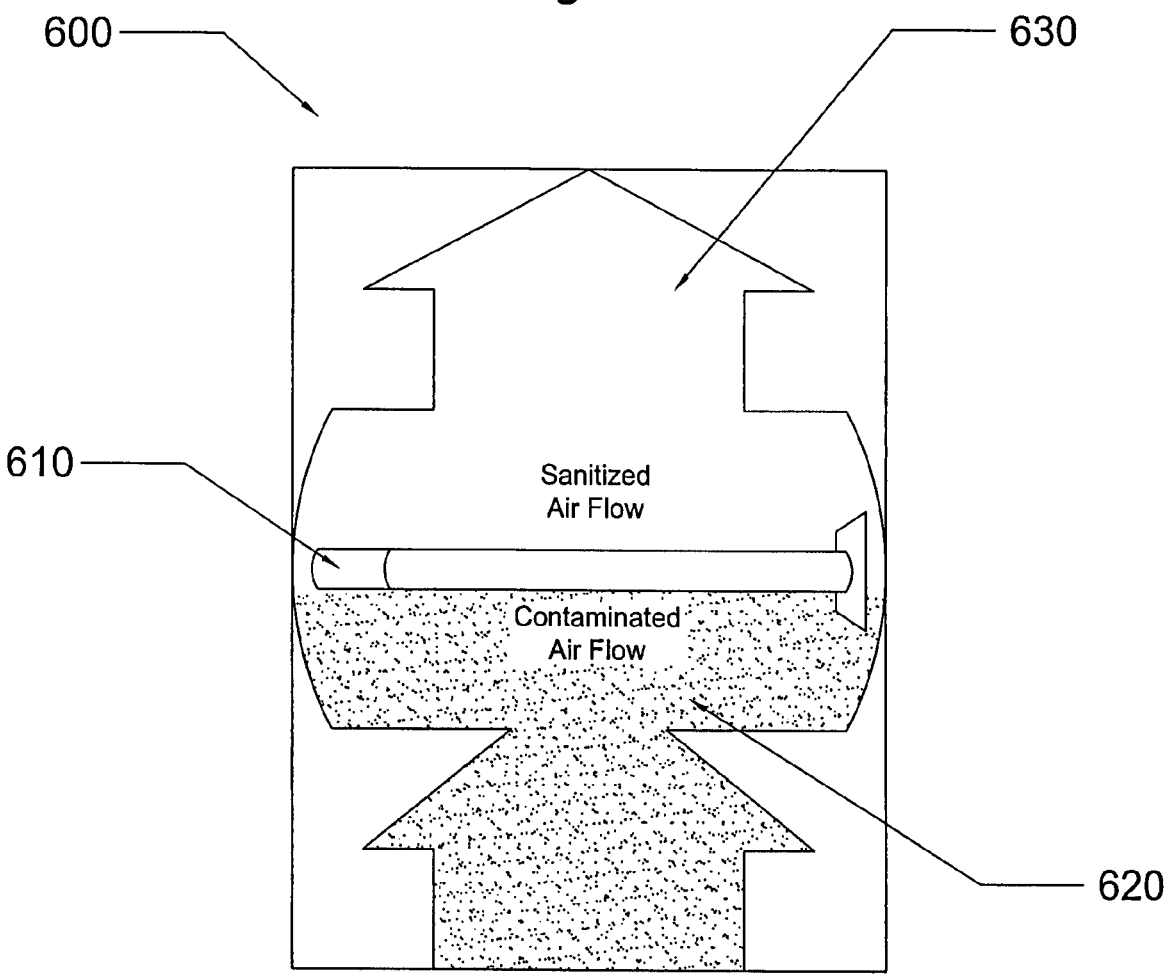
FIG. 6 depicts air flows associated with an ultraviolet lamp.

Next, FIG. 6 depicts air flows associated with an ultraviolet lamp. As circulating air flows past the ultraviolet lamp 610, microorganisms, harmful bacteria, molds, viruses, and other contaminants are destroyed. As shown, contaminated air 620 flows across the ultraviolet lamp 610 producing sanitized air 630 within the air flow path 600. The ultraviolet lamp 610 may be any of a wide variety of ultraviolet radiation sources. In one embodiment, the ultraviolet lamp comprises a germicidal ultraviolet air and surface irradiating fixture of the type designated Biolux WE10 Fixture (with 05-1345 lamp) available from Atlantic Ultraviolet Corporation. In one embodiment, the ultraviolet lamp comprises the aforementioned Biolux germicidal ultraviolet lamp with water resistant enclosures or water tight sealants to prevent malfunction or electric shock due to operation of the ultraviolet lamps in humid or wet environments. The aforementioned Biolux germicidal ultraviolet lamp has an expected life of 20,000 hours continuous operation (2.3 years) and produces 2.9 Watts of ultraviolet radiation measured at 254 nanometers (nm) wavelength at 100 hours and 80 degrees Fahrenheit.

Other ultraviolet lamps may be used and may be suitably selected to deliver a sufficient dosage of ultraviolet radiation given such parameters as surface area (square footage) of intended ultraviolet light coverage, distance between the ultraviolet lamp and the surface, cross-sectional area of the air flow paths through which circulating air is to be sanitized, the velocity of the circulating air, and other application-specific factors depending upon the particular display case configuration. Various ultraviolet lamps may be chosen for use within a particular display case depending upon the specific characteristics of the particular display case. For example, various ultraviolet lamps producing between approximately 3 Watts and 25 Watts output may be used within a particular display case. For instance, the higher output lamps may be used in places where the velocity of circulating air to be sanitized is higher or in places where larger surface areas are to be sanitized. The lower output lamps may be used in locations where the velocity of circulating air is lower, in places involving smaller surface areas, or where the lower output ultraviolet lamps provide secondary sanitation to other ultraviolet lamps provided upstream within the air paths of the display case.

The ultraviolet lamps may comprise cold start or rapid start type ballasts and bulbs (lamps). Further, the ultraviolet lamps may be configured with a variety of duty cycles. In one embodiment, the ultraviolet lamps operate when the display case is powered. In another embodiment, automatic timers may be used to control the operation of the ultraviolet lamps. For example, a power savings mode may be implemented using timers whereby the ultraviolet lamps operate (to sanitize the circulated air and various surfaces) for perhaps only a couple of hours per day. In still another embodiment, the ultraviolet lamps may be configured to operate whenever air is circulated within the display case. For instance, the ultraviolet lamps may be connected to the same electrical power as the air circulation fans. When the circulation fans turn on, the ultraviolet lamps turn on to sanitize the circulating air within the display case.

Figure 7:
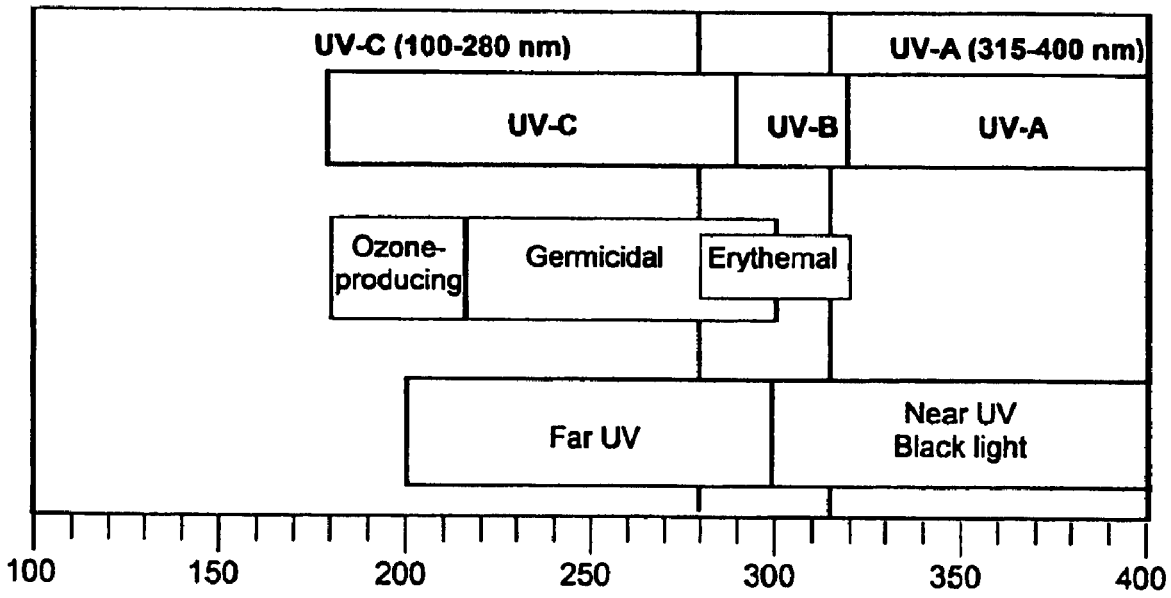
FIG. 7 depicts various ultraviolet radiation wavelength designations and biological effects.

FIG. 7 depicts various ultraviolet radiation wavelength designations and biological effects. Ultraviolet light generally comprises electromagnetic energy having wavelengths from 100 nanometers (nm) to 400 nanometers. Germicidal ultraviolet lamps generally produce radiation across a spectrum of wavelengths with the majority of radiated energy aggregated near 254 nanometers and some energy discharged at shorter and longer wavelengths. Germicidal effectiveness greater at wavelengths near 254 nanometers. Thus, ultraviolet radiation with a relative spectral energy distribution centered at 254 nanometers is sometimes called "germicidal ultraviolet" (as shown in FIG. 7). However, other industry references define "germicidal ultraviolet" in a broader sense, including both the shorter ultraviolet wavelengths (known as UV-C) (approximately 100 nm to 280 nm) as well as the middle ultraviolet wavelengths (known as UV-B) (approximately 280 nm to 315 nm). The broader (and more common) definition of "germicidal ultraviolet" is used herein.

The ultraviolet light at (UV-C) wavelengths just below 200 nm is sometimes called ozone producing since the ultraviolet light at such wavelengths is capable of producing ozone from oxygen (used in water purification applications). The ultraviolet light at UV-B wavelengths is sometimes called erythemal ultraviolet radiation since it is the ultraviolet energy that causes sun burns. The ultraviolet light at longer ultraviolet wavelengths (known as UV-A) (approximately 315 nm to 400 nm) is not considered germicidal and is known as the ultraviolet energy that causes sun tanning. Other designations include "far UV" referring to "germicidal ultraviolet" (in the narrow sense) and "near UV" or "black light" referring to ultraviolet light at longer UV-B and UV-A wavelengths.

Figure 8:
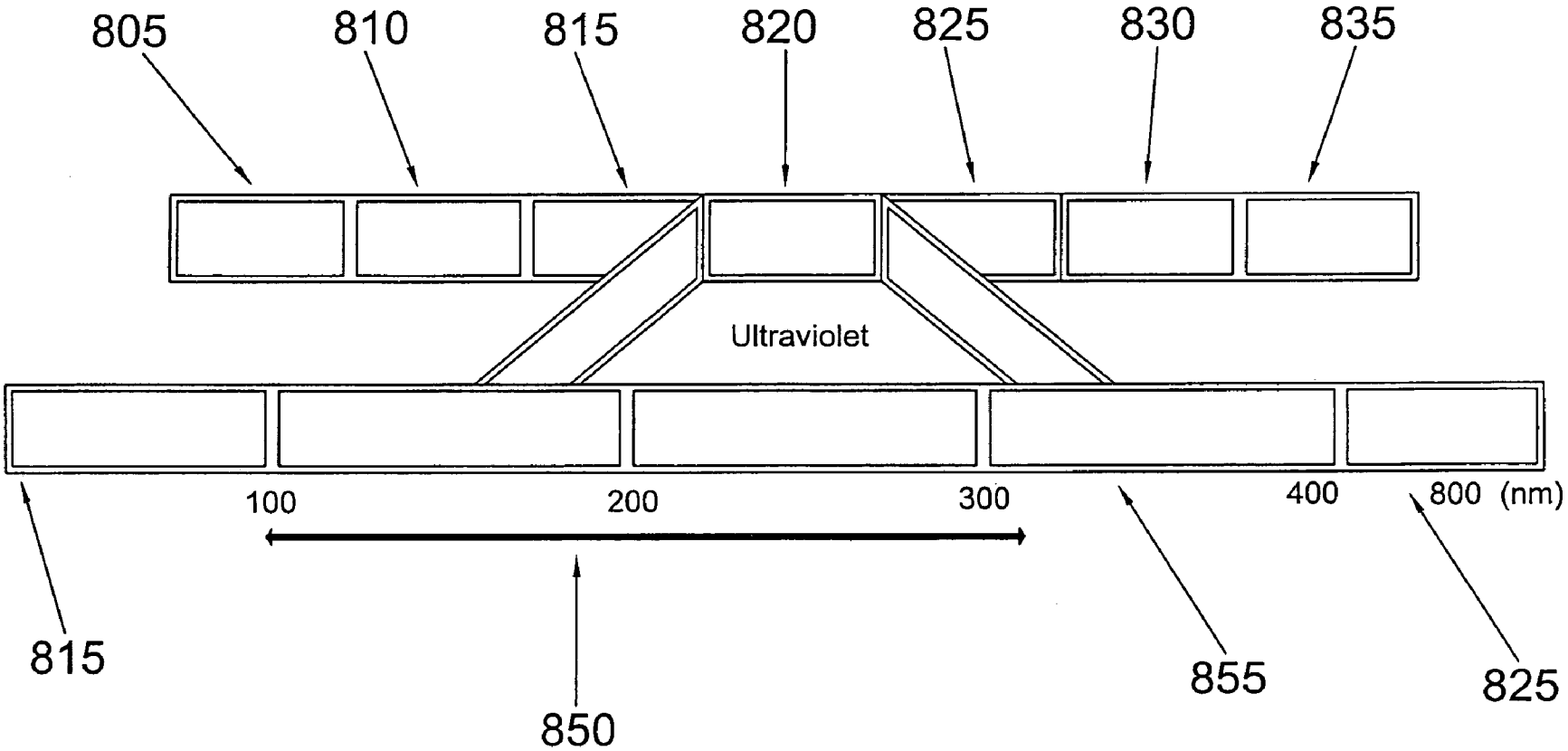
FIG. 8 depicts germicidal wavelengths within a broader electromagnetic energy spectrum.

FIG. 8 depicts germicidal wavelengths within a broader electromagnetic energy spectrum. As shown, the electromagnetic spectrum includes cosmic rays 805, gamma rays 810, X-rays 815, ultraviolet light 820, visible light 825, infrared 830, and radio waves 835. Within this spectral context, between X-rays 815 and visible light 825 comprises ultraviolet light, which, for purposes of the present invention, may be categorized into two types—germicidal ultraviolet light 850 and long-wave ultraviolet 855. Germicidal ultraviolet light 850 comprises germicidal ultraviolet radiation generally having wavelengths from approximately 100 nm to approximately 315 nm (including both UV-C and UV-B).

As described herein, the present invention provides a method and system for an improved display case, comprising a display case having air flow paths for circulating air around one or more objects displayable in a display area in the display case, and one or more ultraviolet radiation elements suitably positioned within the air paths for sanitizing the circulating air to reduce an amount of airborne contaminants therein. Various embodiments are described involving display cases with ultraviolet sanitation.

Although a person having skill in the art may comprehend alterations and modifications of the present invention after having read the foregoing description, it is to be understood that the particular embodiments shown and described by way of illustration are in no way intended to be considered limiting. References to details of particular embodiments are not intended to limit the scope of the claims. Rather, it will be appreciated that many variations, modifications, and embodiments are possible, and all such variations, modifications, and embodiments are to be regarded as being within the spirit and scope of the invention.

What is claimed is:

1. An improved display case, comprising:

a display case having air flow paths for circulating air around one or more objects displayable in a display area in the display case;

a lower trough area of the display case through which the circulating air flows, said lower trough area suitably oriented below substantially all of said display area to catch debris falling from said display area; and one or more ultraviolet radiation elements positioned suitably within said lower trough area so as to sanitize the lower trough area of the display case and air flowing therethrough, without allowing ultraviolet radiation from the one or more ultraviolet radiation elements positioned within the lower trough area from directly contacting the one or more objects displayable in the display area.

2. The improved display case of claim 1, wherein the lower trough area comprises one or more waste drains for draining liquids from the display case.

3. The improved display case of claim 1, wherein at least one or more of the ultraviolet radiation elements is suitably positioned to sanitize surface areas in the lower trough area of the display case.

4. The improved display case of claim 1, further comprising:

one or more refrigeration coils within the air flow paths of the display case, wherein at least one of the ultraviolet radiation elements is positioned suitably to sanitize air received by the one or more refrigeration coils.

5. The improved display case of claim 1, wherein one or more of the ultraviolet radiation elements include reflective shielding for shielding the display area and areas outside the display case from direct exposure of ultraviolet light or for concentrating ultraviolet light radiated from the ultraviolet radiation elements.

6. The improved display case of claim 1, wherein one or more ultraviolet elements are suitably positioned within the display case proximate to a location at which air is released into the display area and whereby the air released into the display area is sanitized by the one or more ultraviolet radiation elements.

7. The improved display case of claim 1, wherein the one or more ultraviolet radiation elements comprise germicidal ultraviolet lamps suitably designed to deliver a dosage of ultraviolet energy sufficient to sanitize circulating air within the display case.

8. The improved display case of claim 1, wherein the one or more ultraviolet radiation elements include water resistant or water tight sealants for operation within the display case.

9. The improved display case of claim 1, wherein one or more automatic timers control the operation of the ultraviolet radiation elements.

10. The improved display case of claim 1, wherein the ultraviolet radiation elements are configurable for a variety of duty cycles.

11. The improved display case of claim 1, wherein the ultraviolet radiation elements are configured to operate whenever air is circulated within said display case.

12. The improved display case of claim 1, wherein one or more automatic timers control the operation of the ultraviolet radiation elements.

13. The improved display case of claim 12, wherein said timers provide a power savings mod of operation whereby the ultraviolet radiation elements may be operated to sanitize the display case for a selectable amount of time per day.

14. A method of sanitizing a display case used for displaying one or more objects displayable in a display area, the method comprising:

circulating air around one or more objects displayed in said display area of said display case through air flow paths in said display case, flowing the circulating air through a lower trough area of the display case, said lower trough area suitably oriented below substantially all of said display area to catch debris falling from said display area, and using one or more ultraviolet radiation elements positioned suitably within said lower trough area so as to sanitize the lower trough area of the display case and air flowing therethrough, without allowing ultraviolet radiation from the one or more ultraviolet radiation elements positioned within the lower trough area from directly contacting the one or more objects displayable in the display area.

15. The method of claim 14, further comprising draining liquids from the display case using one or more waste drains positioned in the lower trough area of the display case.

16. The method of claim 14, further comprising sanitizing surface areas in the lower trough area of the display case using one or more of the ultraviolet radiation elements suitably positioned to sanitize said surface areas.

17. The method of claim 14, further comprising:

refrigerating air circulating within the air flow paths of the display case using one or more refrigeration coils, and sanitizing air received by the one or more refrigeration coils using one or more of the ultraviolet radiation elements.

18. The method of claim 14, further comprising shielding the display area and areas outside the display case from direct exposure of ultraviolet light or concentrating ultraviolet light radiated from the ultraviolet radiation elements using reflective shielding of the ultraviolet radiation elements.

19. The method of claim 14, further comprising sanitizing the air released into the display area using one or more ultraviolet elements suitably positioned within the display case proximate to a location at which air is released into the display area.

* * * * *